US010551794B2

(12) United States Patent
Kawahito

(10) Patent No.: US 10,551,794 B2
(45) Date of Patent: Feb. 4, 2020

(54) DEVELOPING DEVICE INCLUDING EXHAUST DUCT AND FILTER AND IMAGE FORMING APPARATUS INCLUDING DEVELOPING DEVICE

(71) Applicant: SHARP KABUSHIKI KAISHA, Sakai, Osaka (JP)

(72) Inventor: Hiroshi Kawahito, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/371,567

(22) Filed: Apr. 1, 2019

(65) Prior Publication Data

US 2019/0302691 A1 Oct. 3, 2019

(30) Foreign Application Priority Data

Apr. 3, 2018 (JP) ..... 2018-071315

(51) Int. Cl.
*G03G 15/00* (2006.01)
*G03G 15/08* (2006.01)
*G03G 21/20* (2006.01)

(52) U.S. Cl.
CPC ..... *G03G 21/206* (2013.01); *G03G 15/0875* (2013.01); *G03G 2221/1645* (2013.01)

(58) Field of Classification Search
CPC ..... G03G 15/0891; G03G 21/206
USPC ..... 399/92, 93, 98, 254
See application file for complete search history.

(56) References Cited

U.S. PATENT DOCUMENTS 10,289,027 B2 * 5/2019 Sako et al. ..... G03G 15/0891

FOREIGN PATENT DOCUMENTS

JP 2009-223075 A 10/2009

* cited by examiner

*Primary Examiner* — William J Royer
(74) *Attorney, Agent, or Firm* — ScienBiziP, P.C.

(57) ABSTRACT

A developing device includes a developer vessel, a flow-path forming portion, and an exhaust duct. The developer vessel accommodates developer composed of toner and carrier. The flow-path forming portion includes a plurality of connection flow paths. The exhaust duct has an intake port communicating with the plurality of connection flow paths, and a filter that covers the intake port is disposed at the intake port of the exhaust duct. Each of the plurality of connection flow paths has an inlet communicating with an internal space of the developer vessel, an outlet communicating with an internal space of the exhaust duct, and a cross-sectional area increasing 5 to 20 times from the inlet toward the outlet.

8 Claims, 7 Drawing Sheets

DEVELOPING DEVICE INCLUDING EXHAUST DUCT AND FILTER AND IMAGE FORMING APPARATUS INCLUDING DEVELOPING DEVICE

BACKGROUND

1. Field

The present disclosure relates to a developing device and an image forming apparatus including the developing device.

2. Description of the Related Art

An example of a developing device of the related art is disclosed in Japanese Unexamined Patent Application Publication No. 2009-223075. The developing device disclosed in Japanese Unexamined Patent Application Publication No. 2009-223075 includes a development tank that accommodates developer therein, a pressure reducing portion that has a space surrounded by a wall above the development tank and reduces internal pressure of the development tank, and a filter installed inside the pressure reducing portion.

The pressure reducing portion includes an intake port that is open, above a developer transport member disposed inside the development tank, in an area where a developer carrier and the developer transport member face each other and an exhaust port that is open toward an end portion of the developing device in the longitudinal direction.

In the developing device of the related art, however, since the developer scattering from the inside of the development tank toward the pressure reducing portion reaches the filter with almost no reduction in the force or energy, the developer tends to adhere to the filter, and the filter may be clogged in a short period of time. When the filter is clogged, exhaust performance decreases and the pressure inside the development tank rises and thus the scattered developer may pass through the filter and leak to the outside of the developing device.

Hence, it is desirable to provide a developing device and an image forming apparatus including the developing device that are novel.

It is also desirable to provide a developing device and an image forming apparatus including the developing device capable of ensuring a sufficient amount of exhaust from a development tank and extending the life of a filter.

SUMMARY

According to an aspect of the disclosure, there is provided a developing device including a development tank, an exhaust duct, a filter, and a flow-path forming portion. The development tank accommodates developer. The exhaust duct is disposed above the development tank and has an intake port in a bottom wall. The filter is disposed at the intake port of the exhaust duct. The flow-path forming portion includes a plurality of connection flow paths which extend in a top-bottom direction and each of which has an inlet communicating with an internal space of the development tank and an outlet communicating with the intake port of the exhaust duct. Each of the plurality of connection flow paths has a cross-sectional area increasing from the inlet toward the outlet.

According to another aspect of the disclosure, there is provided an image forming apparatus including the developing device of the above-described aspect.

DESCRIPTION OF THE EMBODIMENTS

First Embodiment

Figure 1:
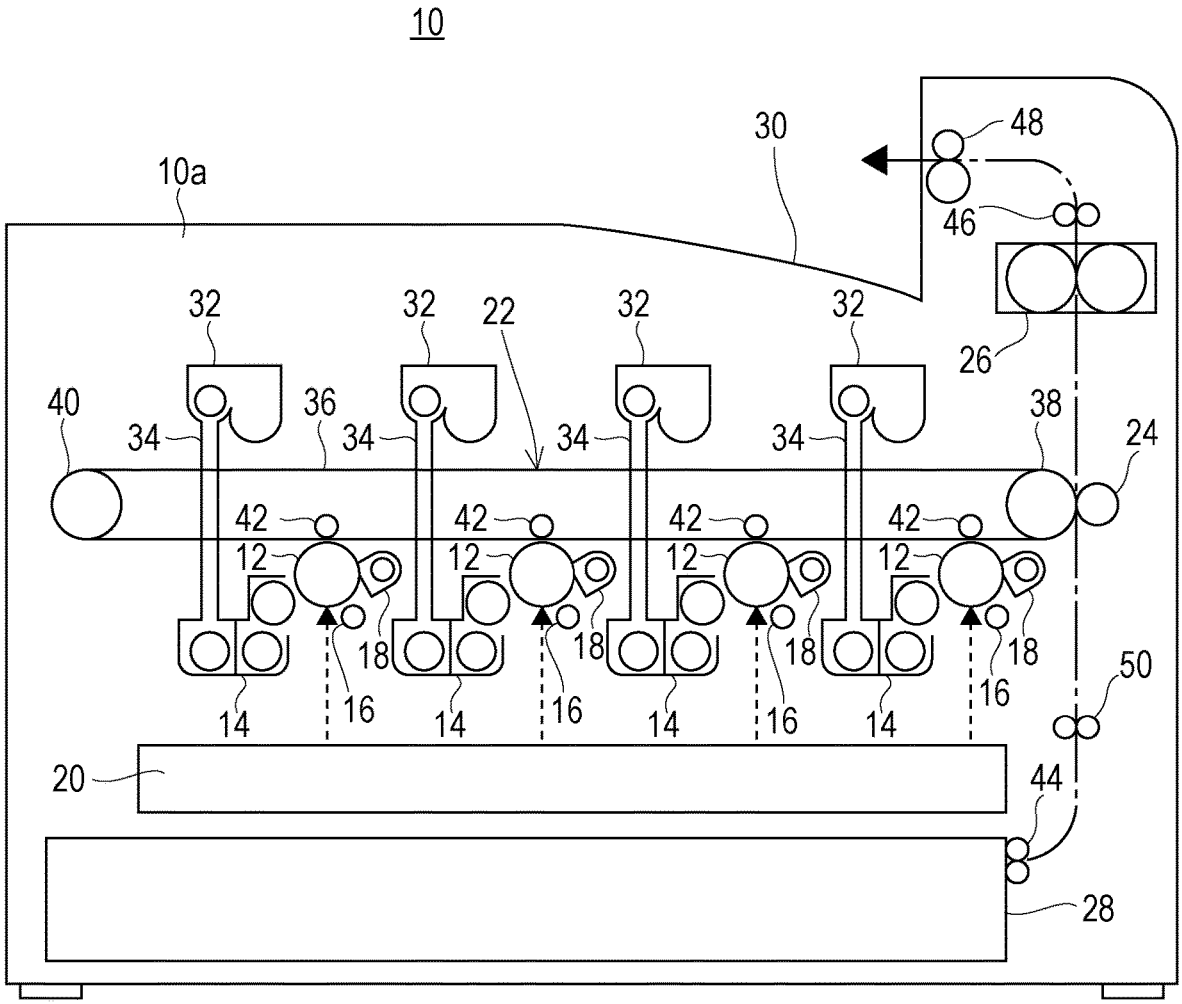
FIG. 1 is an illustration schematically illustrating an example of an overall configuration of an image forming apparatus of a first embodiment.

FIG. 1 is a schematic view illustrating an overall configuration of an image forming apparatus 10 according to an embodiment of the present disclosure viewed from the front.

Referring to FIG. 1, the image forming apparatus 10 of the first embodiment is a color printer that forms a multicolor or monochrome image on a sheet (recording medium) by an electrophotographic method. However, the image forming apparatus 10 may be a monochrome printer. Moreover, the image forming apparatus 10 is not limited to a printer, and may be a copying machine, a facsimile, or a multifunction peripheral having these functions.

In this specification, when the image forming apparatus 10 is viewed from the front, a left side of image forming apparatus 10 in a horizontal direction is defined to be a left direction, and a right side thereof is defined to be a right direction. Moreover, when the image forming apparatus 10 is viewed from above (or below), a front side of the image forming apparatus 10 in a depth direction is defined to be a front direction, and a rear side of the image forming apparatus 10 is defined to be a backward direction.

First, a basic configuration of the image forming apparatus 10 will be briefly described. As illustrated in FIG. 1, the image forming apparatus 10 includes components such as a photosensitive drum 12, a developing device 14, a charger 16, a cleaning unit 18, an exposure device 20, an intermediate transfer belt unit 22, a secondary transfer roller 24, and a fixing unit 26. The image forming apparatus 10 forms an image on a sheet transported from a sheet feed tray 28, and discharges the sheet on which the image has been formed to a discharge tray 30. As image data for the formation of an image on a sheet, image data input from an external computer is used. However, in a case where the image forming apparatus 10 has a scanner function, not only the image data input from the outside but also image data read from a document by a scanner can be used.

Respective components described above are accommodated in a housing 10*a* of the image forming apparatus 10. In addition, a control unit including a CPU, a memory, and the like (not shown) is provided in the housing 10*a* of the image forming apparatus 10. The control unit transmits a control signal to each portion of the image forming apparatus 10 to cause the image forming apparatus 10 to execute various operations.

Here, the image forming apparatus 10 handles image data according to images of four colors of black (BK), magenta (M), cyan (C), and yellow (Y). Therefore, four photosensitive drums 12, four developing devices 14, four chargers 16, and four cleaning units 18 are provided such that four latent images corresponding to respective colors can be formed, and four image stations are constituted by these components. For example, four image stations are arranged in a line along a traveling direction (circumferential movement direction) of a surface of an intermediate transfer belt 36, and the four image stations for black, magenta, cyan, and yellow are arranged in this order from a downstream side in the traveling direction of the intermediate transfer belt 36, that is, from a side close to the secondary transfer roller 24. However, an order of arrangement of respective colors is appropriately changeable.

At each of the image stations, the charger 16, the developing device 14, and the cleaning unit 18 are disposed in this order around the photosensitive drum 12 in a rotation direction (clockwise in FIG. 1) of the photosensitive drum 12. The developing device 14 is disposed such that a rotation axis of a development roller 146 (see FIG. 4) is aligned parallel to the rotation axis of the photosensitive drum 12. Moreover, the charger 16 is disposed such that a rotation axis of the charger 16 is aligned parallel to the rotation axis of the photosensitive drum 12. Furthermore, the cleaning unit 18 is disposed so that a longitudinal direction of a cleaning blade (not shown) coincides with a rotation axis direction of the photosensitive drum 12. However, in FIG. 1, the rotation axis direction of the photosensitive drum 12 is the depth direction (front-back direction) of the image forming apparatus 10 when viewed from the back.

The photosensitive drum 12 is an image carrier that has a photosensitive layer (photoconductive layer) formed on a surface of a substrate having conductivity, and is supported so as to be rotatable around an axis by a driving unit (not shown). The substrate can adopt various shapes such as a cylindrical shape, a columnar shape, and a thin film sheet shape. The photosensitive layer is formed of a material exhibiting conductivity when irradiated with light. The photosensitive drum 12 of the first embodiment is a photosensitive drum including a cylindrical substrate made of aluminum and a photosensitive layer formed on an outer peripheral surface of the substrate and made of amorphous silicon (a-Si), selenium (Se), or organic photo conductor (OPC).

The developing device 14 visualizes an electrostatic latent image FORMED on a surface of the photosensitive drum 12 with toner (forms a toner image). A toner cartridge 32 is connected to the developing device 14 via a toner supply pipe 34. The toner cartridge 32 is a container which stores unused toner and carrier, and is disposed above the developing device 14 to supply (replenish) the toner to the developing device 14 and replenish the carrier. The toner supply pipe 34 links (connects) the toner cartridge 32 and a toner replenishing port formed in the developing device 14. The specific configuration of the developing device 14 will be described later.

The charger 16 is a device that charges the surface of the photosensitive drum 12 to a predetermined polarity and potential. As the charger 16, a brush type charging device, a roller type charging device, a corona discharge device, an ion generating device, or the like may be used.

After the toner image is transferred from the photosensitive drum 12 to the intermediate transfer belt 36, the cleaning unit 18 removes and collects the toner remaining on the surface of the photosensitive drum 12 to clean the surface of the photosensitive drum 12. Therefore, for example, the cleaning unit 18 includes a cleaning blade which is a plate-like member to scrape off the toner and a collection container which collects the scrapped toner.

The exposure device 20 is disposed below the developing device 14. The exposure device 20 is configured as a laser scanning unit (LSU) including a laser emission unit and a reflective mirror. The exposure device 20 forms an electrostatic latent image according to image data on the surface of the photosensitive drum 12 by exposing the charged surface of the photosensitive drum 12.

The intermediate transfer belt unit 22 includes the intermediate transfer belt 36, a driving roller 38, a driven roller 40, and four intermediate transfer rollers (primary transfer rollers) 42 and is disposed above the photosensitive drum 12.

The intermediate transfer belt 36 is an endless belt having flexibility and made of a synthetic resin, rubber, or the like in which a conductive material such as carbon black is combined therewith. The intermediate transfer belt 36 is stretched over a plurality of rollers such as the driving roller 38 and the driven roller 40, and is disposed so that the surface (outer peripheral surface) of the intermediate transfer belt 36 abuts on the surface of the photosensitive drum 12. The intermediate transfer belt 36 rotates (circulates) in a predetermined direction (counterclockwise in FIG. 1) as the driving roller 38 rotates.

The driving roller 38 is disposed so as to be rotatable around an axis by the driving unit (not shown). The driven roller 40 is rotated by the circumferential movement of the intermediate transfer belt 36, and imparts a constant tension to the intermediate transfer belt 36 so that the intermediate transfer belt 36 does not go slack.

The intermediate transfer roller 42 is disposed at each position facing a corresponding photosensitive drum 12 with the intermediate transfer belt 36 interposed therebetween and is brought into pressure contact with an inner circumferential surface of the intermediate transfer belt 36 to be rotated with the circumferential movement of the intermediate transfer belt 36. Although illustration is omitted, a transfer power source which applies a transfer bias is connected to the intermediate transfer roller 42. During image formation, a voltage with a polarity opposite to a charged polarity of the toner constituting the toner image formed on the surface of the photosensitive drum 12 is applied to the intermediate transfer roller 42. As a result, a transfer electric field is formed between the photosensitive drum 12 and the intermediate transfer belt 36, and the toner image formed on the photosensitive drum 12 is transferred onto an outer peripheral surface of the intermediate transfer belt 36 by the action of the transfer electric field. For example, in the case of forming a color image, the toner images of respective colors formed on the respective photosensitive drums 12 are sequentially overlapped and transferred (primary transfer) onto the intermediate transfer belt 36, and a multicolor toner image is formed on the outer peripheral surface of the intermediate transfer belt 36.

The secondary transfer roller 24 is disposed at a position facing the driving roller 38 with the intermediate transfer belt 36 interposed therebetween. A transfer power source (not shown) is connected to the secondary transfer roller 24, and during the image formation, the transfer power source applies a voltage (secondary transfer voltage) to the secondary transfer roller 24. While a sheet is passing through a transfer nip region between the intermediate transfer belt 36 and the secondary transfer roller 24, the toner image formed on the outer peripheral surface of the intermediate transfer belt 36 is transferred (secondary transfer) onto the sheet by the action of the transfer electric field formed by the secondary transfer roller 24 to which voltage is applied. Thereafter, the toner remaining on the surface of the intermediate transfer belt 36 is removed and collected by a transfer belt cleaning unit (not shown).

The fixing unit 26 includes a heat roller and a pressure roller, and is disposed above the secondary transfer roller 24. The heat roller is set to a predetermined fixing temperature, and as a sheet passes through a fixing nip region between the heat roller and the pressure roller, a toner image transferred onto the sheet is melted, mixed, and pressure-contacted, and thereby the toner image is thermally fixed on the sheet.

Inside the housing 10*a* of the image forming apparatus 10, a sheet transport path through which a sheet placed on the sheet feed tray 28 is fed to the discharge tray 30 via the secondary transfer roller 24 and the fixing unit 26 is formed. Sheet transport units such as transport rollers 44, 46, 48 and registration rollers 50 are disposed appropriately on the sheet transport path.

During the image formation, sheets placed on the sheet feed tray 28 are guided one by one to the sheet transport path by a pickup roller (not shown), and transported to the registration rollers 50 by the transport rollers 44. The registration rollers 50 transport a sheet to the secondary transfer roller 24 at a timing when a leading edge of the sheet and a leading edge of the toner image on the intermediate transfer belt 36 are aligned, and the toner image is transferred onto the sheet. Thereafter, the sheet passes through the fixing device 26, and the unfixed toner on the sheet is melted and fixed by heat, and the sheet is discharged onto the discharge tray 30 via the transport rollers 46 and 48.

In such the image forming apparatus 10, as will be described later, a developer (two-component developer) composed of a black, cyan, magenta, or yellow toner and carrier is stored in a developer vessel (development tank) 140 disposed in the developing device 14. The carrier is a magnetic material such as iron powder or ferrite. The same applies hereafter.

For example, the developing device 14 is a trickle development type developing device. Briefly, the trickle development represents a technique of having mixed new carrier with toner in the toner cartridge 32 at a predetermined ratio, supplying (replenishing) the new carrier into the developing device 14 at the same time as the supply (replenishment) of the toner, and discharging the excessive developer from the developing device 14 to thereby sequentially replace deteriorated carrier in the developing device 14 with new carrier.

In this specification, simple description of "the developer is discharged" or the like means that the developer in which the deteriorated carrier or the deteriorated carrier and the toner are mixed is discharged. Although the deteriorated carrier may not be replaced with the unused carrier, basically, the developing device 14 is configured such that the deteriorated carrier can be replaced with the unused carrier.

In the developing device 14, as the toner is consumed by forming an image on the sheet, the developer including the toner corresponding to the amount of consumption is replenished. Therefore, a toner density detection sensor (toner density sensor) (not shown) is provided in the developing device 14, and based on the output of the toner density detection sensor, the toner density (T/D: T is a toner, and D is a developer) inside the developing device 14 is detected. In accordance with the detected toner density, the replenishment of the developer from the toner cartridge 32 is controlled.

Figure 2:
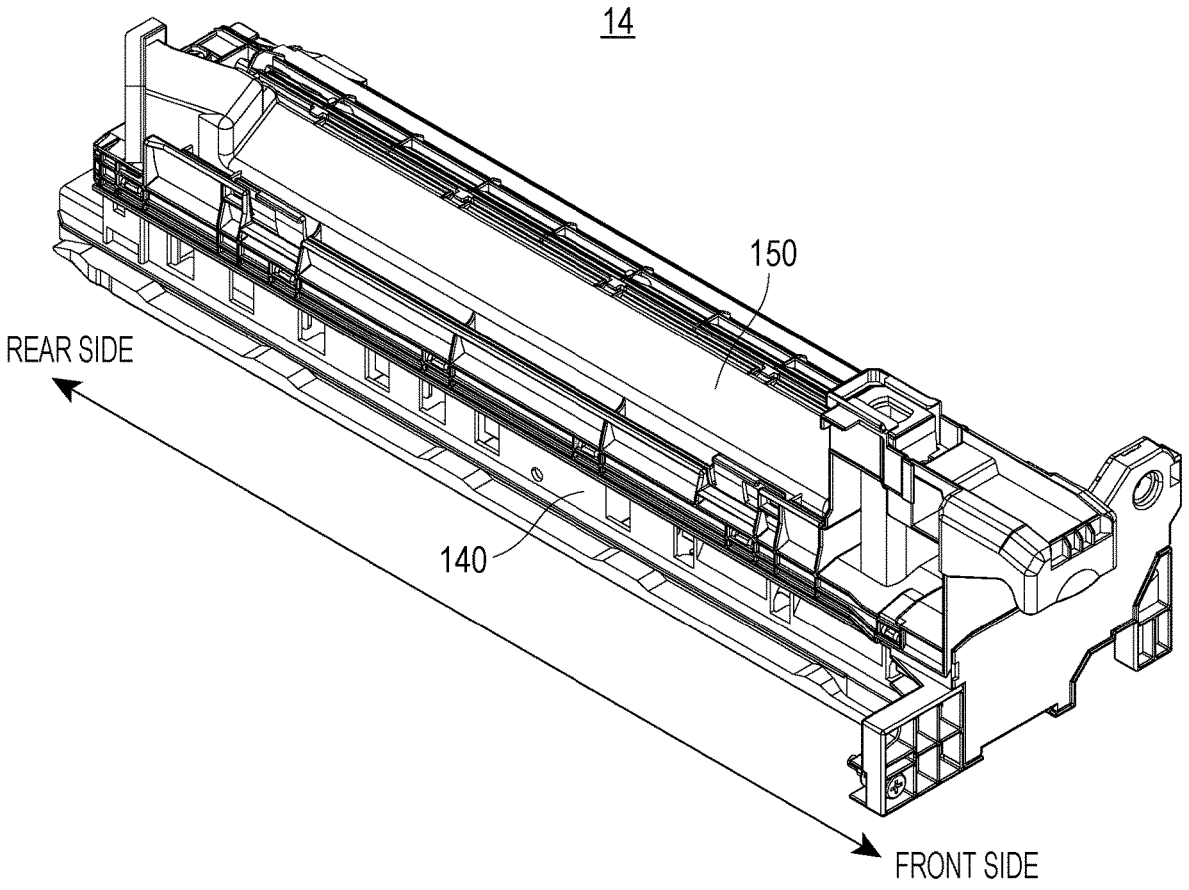
FIG. 2 is a perspective view of a developing device illustrated in FIG. 1 viewed obliquely from above.
Figure 3:
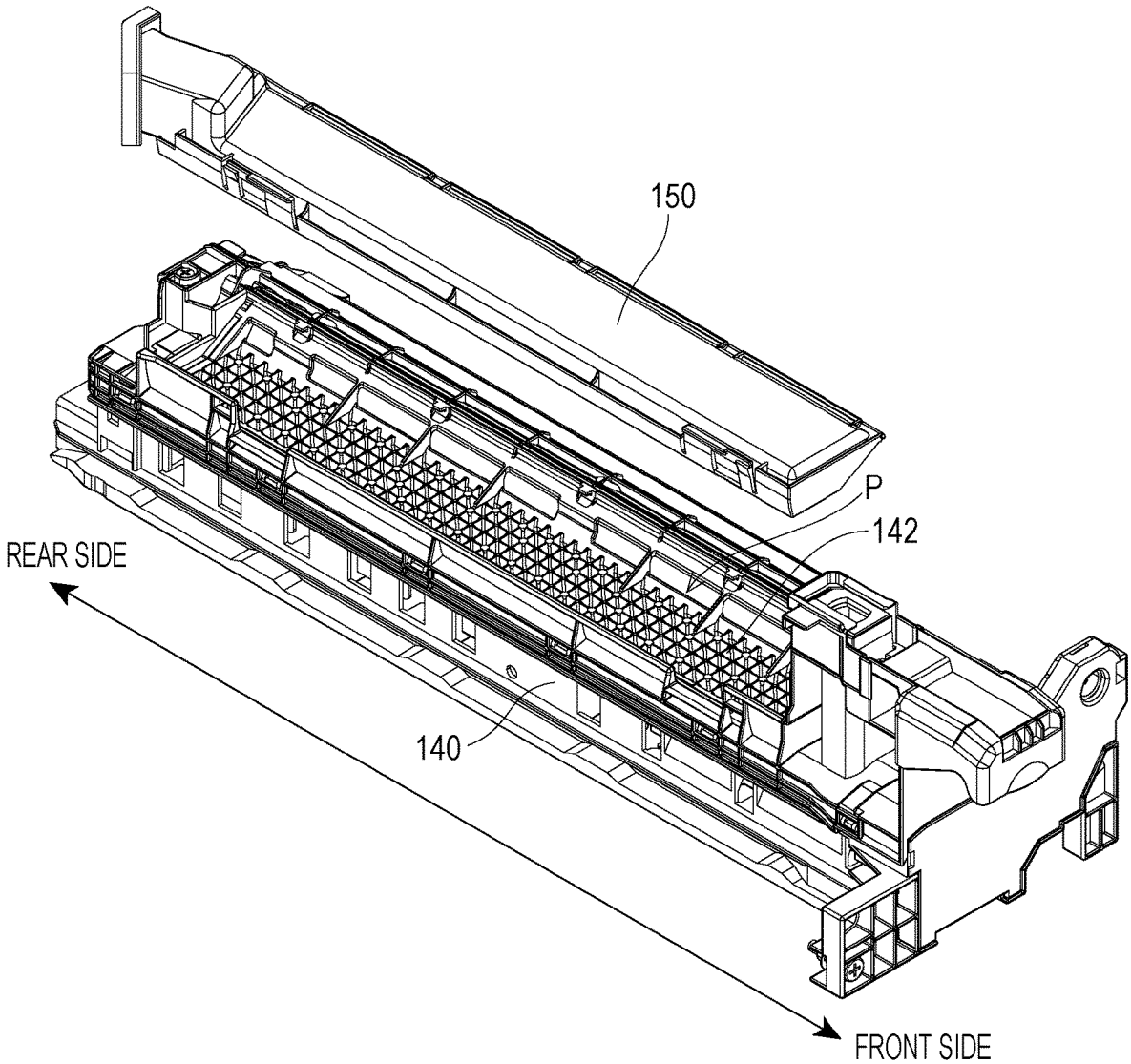
FIG. 3 is a perspective view of a developer vessel with an exhaust duct removed viewed obliquely from above.
Figure 4:
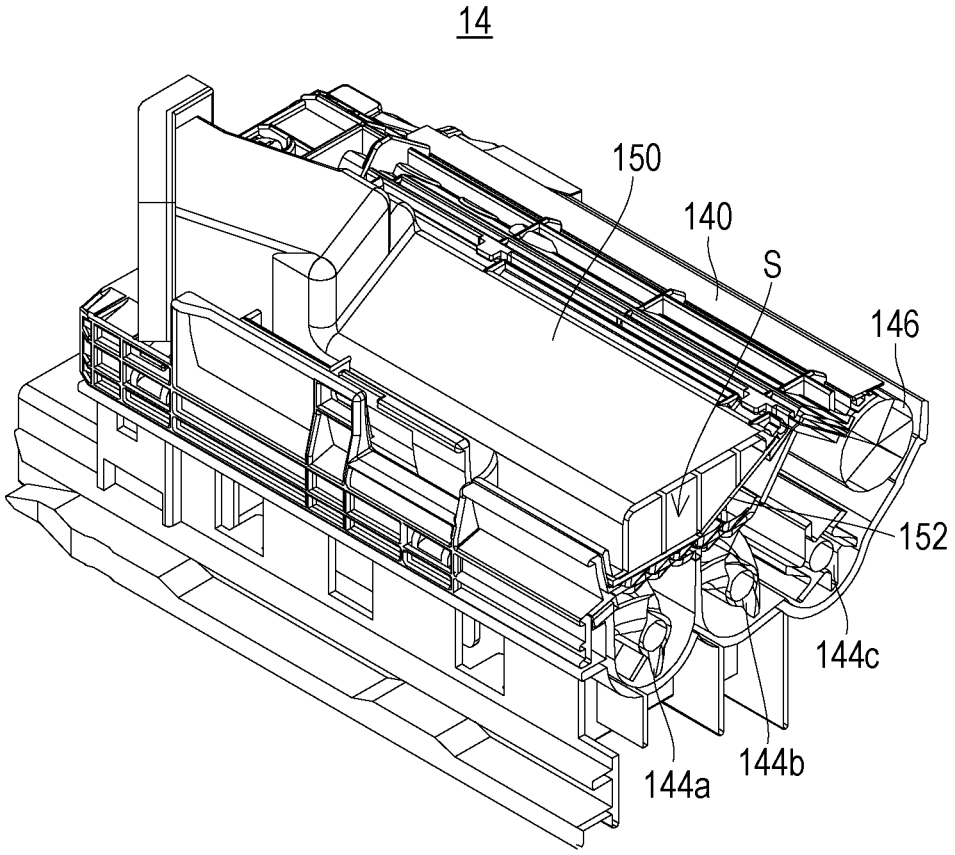
FIG. 4 is a schematic sectional view illustrating part of the developing device.
Figure 5:
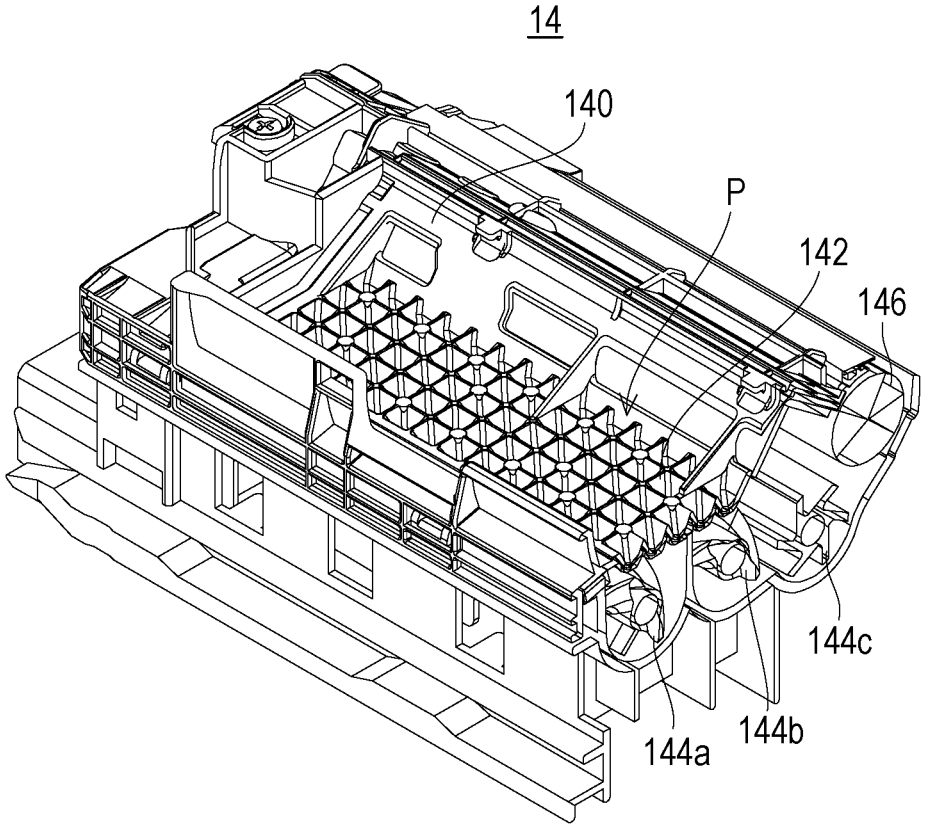
FIG. 5 is a schematic sectional view illustrating part of the developer vessel with the exhaust duct removed.
Figure 6:
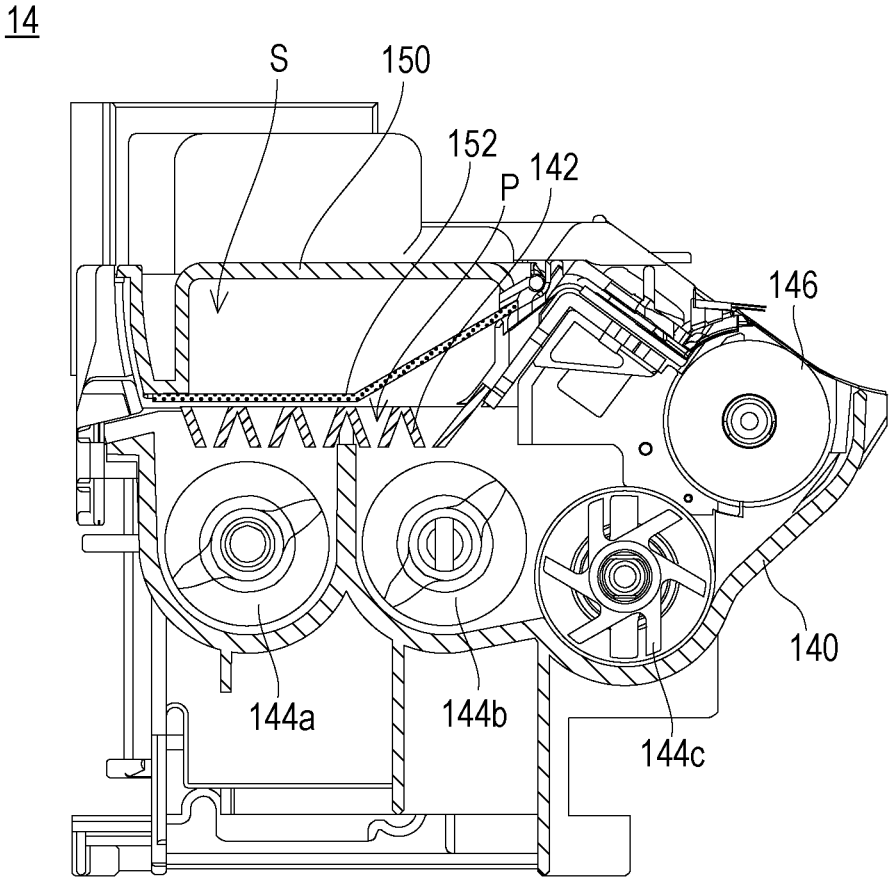
FIG. 6 is a schematic sectional view illustrating part of the developing device.

FIG. 2 is a perspective view of the developing device 14 illustrated in FIG. 1 viewed obliquely from above. FIG. 3 is a perspective view of a developer vessel 140 with an exhaust duct 150 removed viewed obliquely from above. FIG. 4 is a schematic sectional view illustrating part of the developing device 14. FIG. 5 is a schematic sectional view illustrating part of the developer vessel 140 with the exhaust duct 150 removed. FIG. 6 is a schematic sectional view illustrating part of the developing device 14.

As illustrated in FIGS. 2 to 6, the developing device 14 includes the developer vessel (development tank) 140 and the exhaust duct 150.

The developer vessel 140 is a container which accommodates a first transport screw 144*a*, a second transport screw 144*b*, a third transport screw 144*c*, the development roller 146, and the like, and accommodates the developer, and has a long and narrow box shape extending in the front-back direction.

The first transport screw 144*a* and the second transport screw 144*b* are members which circulate the developer in a predetermined direction in the developer vessel 140 while stirring the toner and the carrier. Moreover, the third transport screw 144*c* is a member which transports the toner and the carrier toward the development roller 14G while stirring the toner and the carrier. The first transport screw 144*a*, the second transport screw 144*b*, and the third transport screw 144*c* are rotated by a rotation driving source (not shown) such as a motor. The toner accommodated in the developer vessel 140 is stirred by the first transport screw 144*a*, the second transport screw 144*b*, and the third transport screw 144*c*, and rubbed against the carrier to be charged.

The development roller 146 is a magnet roller functioning as a developer carrier, and is disposed at a position facing the photosensitive drum 12. The development roller 146 carries the developer in the developer vessel 140 on the surface, and supplies the toner contained in the carried developer to the surface of the photosensitive drum 12. Accordingly, the electrostatic latent image formed on the surface of the photosensitive drum 12 is developed (visualized).

As illustrated in FIGS. 3, 5, and 6, the developing device 14 includes a flow-path forming portion 142. The flow-path forming portion 142 includes a plurality of connection flow paths P which communicate (connect) an internal space of the developer vessel 140 and an internal space S of the exhaust duct 150. The plurality of connection flow paths P extend in a top-bottom direction, and may be arranged in a matrix so as to be aligned in front-back and right-left directions. The specific configuration of the connection flow path P will be described later.

In the first embodiment, the flow-path forming portion 142 is integrally formed with a top wall of the developer vessel 140. That is, part of the top wall of the developer vessel 140 may constitute the flow-path forming portion 142.

As illustrated in FIGS. 2 to 4 and 6, the exhaust duct 150 is attachably and detachably provided on an upper surface of the developer vessel 140, and formed substantially in a long and narrow box shape extending in parallel (front-back direction) with the longitudinal direction of the developer vessel 140. Moreover, the exhaust duct 150 is disposed so as to cover at least all of the plurality of connection flow paths P from an upper side. Furthermore, a communication hole (corresponding to an intake port) communicating with the plurality of connection flow paths P is formed in the bottom wall of the exhaust duct 150 in a state of being attached to the upper surface of the developer vessel 140. That is, when the exhaust duct 150 is attached to the upper surface of the developer vessel 140, the internal space S of the exhaust duct 150 and the internal space of the developer vessel 140 communicate (are connected) via the plurality of connection flow paths P.

Moreover, a filter 152 that covers the communication hole is provided in the communication hole of the exhaust duct 150. The filter 152 is formed such that meshes of the filter are smaller than the particles of the developer, and air can pass through by suppressing the discharge of the developer (catching the developer).

Furthermore, although illustration is omitted, the exhaust duct 150 has an exhaust port disposed on a rear side. The exhaust port of the exhaust duct 150 is connected to an exhaust port (not shown) on a rear side of the housing 10*a* of the image forming apparatus 10. Moreover, an exhaust fan which discharges the air in the internal space S of the exhaust duct 150 to the outside of the housing 10*a* may be disposed at the exhaust port of the housing 10*a*. When the exhaust fan is operated, the air in the internal space of the developer vessel 140 and the air in the internal space S of the exhaust duct 150 are forcibly discharged to the outside of the housing 10*a*.

Figure 7:
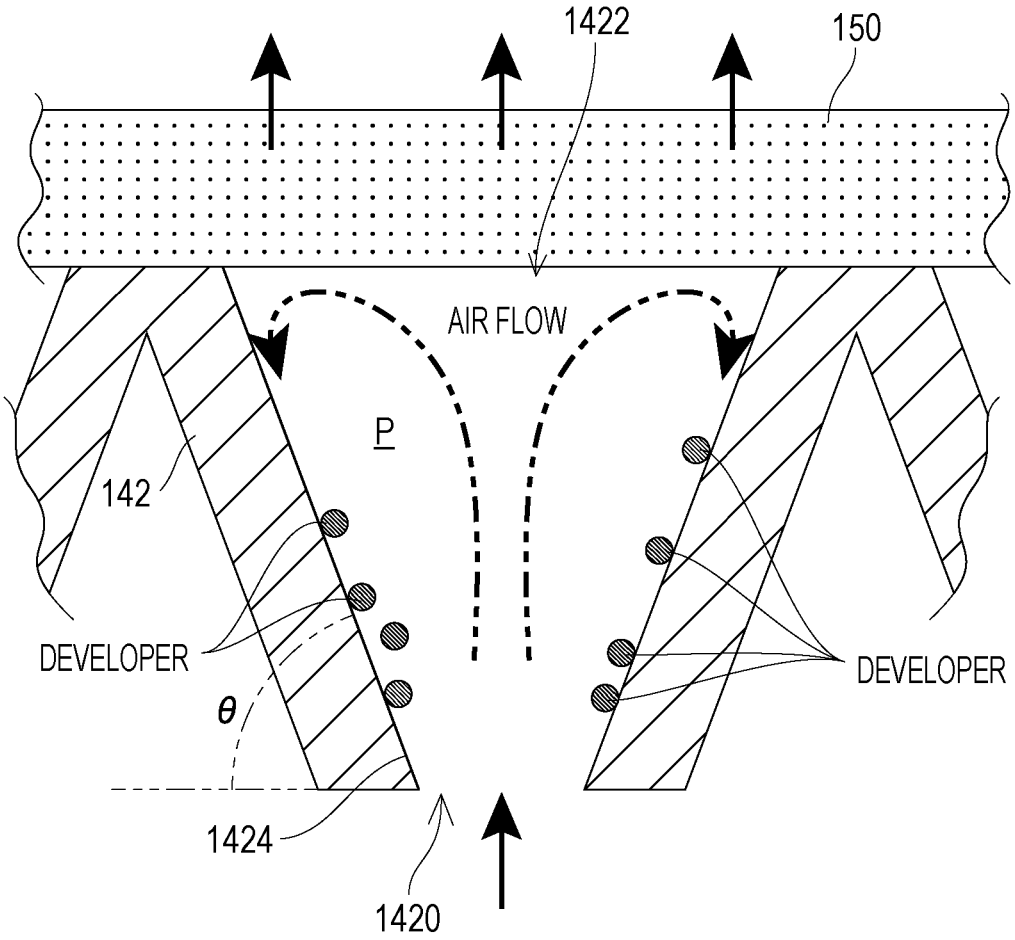
FIG. 7 is a schematic sectional view illustrating a configuration of a connection flow path.

Next, the specific configuration of the connection flow path P will be described with reference to FIG. 7. As illustrated in FIG. 7, the connection flow path P has an inlet 1420 communicating with the internal space of the developer vessel 140, an outlet 1422 communicating with the internal space S of the exhaust duct 150, and an inclined surface 1424 connecting the inlet 1420 and the outlet 1422.

The inlet 1420 is formed by a substantially annular or rectangular opening end formed on a lower surface (bottom surface) of the flow-path forming portion 142.

The outlet 1422 is formed by a substantially annular or rectangular opening end formed on an upper surface (top surface) of the flow-path forming portion 142. However, a cross-sectional area (area of the outlet 1422) of the connection flow path P in the outlet 1422 may be substantially 5 to 20 times the cross-sectional area (area of the inlet 1420) of the connection flow path P in the inlet 1420. For example, the inlet 1420 is formed by an annular opening end φ1.6 mm. In this case, the area of the inlet 1420 is approximately 2 $mm^2$. Therefore, the outlet 1422 is formed so that the area of the outlet 1422 is 10 to 40 $mm^2$. For example, the outlet 1422 is formed by a square opening end of 5 mm.

The inclined surface 1424 extends in the top-bottom direction, and is configured such that the cross-sectional area of the connection flow path P continuously increases from the inlet 1420 toward the outlet 1422. That is, the connection flow path P is formed in a mortar shape.

However, the inclined surface 1424 is inclined at an angle equal to or greater than an angle of repose of the developer. Specifically, the inclined surface 1424 may be inclined substantially 45° to 80° with respect to the horizontal direction.

In the connection flow path P configured as described above, when the exhaust fan is operated, an air flow from the internal space of the developer vessel 140 toward the internal space S of the exhaust duct 150 is generated. Specifically, an upward air flowing from the inlet 1420 (lower part) to the outlet 1422 (upper part) is generated in the connection flow path P. However, as described above, since the cross-sectional area of the connection flow path P continuously increases from the inlet 1420 toward the outlet 1422, not only the upward air flow but also a spiral air flow flowing in a radial direction of the connection flow path P without reaching the surface (lower surface) of a filter 152 are generated. Therefore, at least part of the developer contained in the air flowing into the connection flow path P from the internal space of the developer vessel 140 follows the spiral air flow flowing in the radial direction of the connection flow path P and adheres to the inclined surface 1424 without reaching the surface of the filter 152. Therefore, it is possible to reduce the amount of the developer that reaches the surface of the filter 152.

As described above, in the first embodiment, it is possible to reduce the amount of developer reaching the surface of the filter 152 and to suppress the clogging of the filter 152. Therefore, it is possible to ensure a sufficient amount of exhaust from the development tank and to extend the life of the filter.

Moreover, in the first embodiment, since the inclined surface 1424 is inclined at an angle equal to or greater than the angle of repose of the developer, when the exhaust fan is stopped, the developer attached to the inclined surface 1424 moves downward by the weight of the developer, and returns to the inside of the developer vessel 140 from the inlet 1420 of the connection flow path P. Therefore, it is possible to suppress excessive decrease of the amount of the developer in the developer vessel 140.

Second Embodiment

The image forming apparatus 10 of a second embodiment is the same as the first embodiment except that the configuration of the developing device 14 is partially changed, and therefore the duplicate explanation will be omitted.

In the second embodiment, the flow-path forming portion 142 is formed integrally with the bottom wall of the exhaust duct 150. That is, part of the bottom wall of the exhaust duct 150 may constitute the flow-path forming portion 142.

According to the second embodiment, as in the first embodiment, it is possible to ensure a sufficient amount of exhaust from the development tank and extend the life of the filter.

Third Embodiment

The image forming apparatus 10 of a third embodiment is the same as the first embodiment except that the configuration of the developing device 14 is partially changed, so the duplicate explanation will be omitted.

In the third embodiment, the flow-path forming portion 142 is formed of a member attachably and detachably provided in the developer vessel 140 or the exhaust duct 150. That is, the developing device 14 includes a member (flow-path forming member) different from the developer vessel 140 and the exhaust duct 150, and the flow-path forming portion 142 is formed by this flow-path forming member.

According to the third embodiment, as in the first embodiment, it is possible to secure a sufficient amount of exhaust from the development tank and extend the life of the filter.

The specific shapes and the like mentioned in the above embodiments are mere examples and can be appropriately changed according to actual products.

The present disclosure contains subject matter related to that disclosed in Japanese Priority Patent Application JP 2018-071315 filed in the Japan Patent Office on Apr. 3, 2018, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A developing device comprising:

a development tank that accommodates developer;

an exhaust duct that is disposed above the development tank and has an intake port in a bottom wall;

a filter that is disposed at the intake port of the exhaust duct; and a flow-path forming portion that includes a plurality of connection flow paths which extend in a top-bottom direction and each of which has an inlet communicating with an internal space of the development tank and an outlet communicating with the intake port of the exhaust duct, wherein each of the plurality of connection flow paths has a cross-sectional area increasing from the inlet toward the outlet.

2. The developing device according to claim 1, wherein each of the plurality of connection flow paths has a surface inclined 45° to 80° with respect to a horizontal direction.

3. The developing device according to claim 1, wherein a cross-sectional area of the outlet is 5 to 20 times a cross-sectional area of the inlet.

4. The developing device according to claim 1, wherein the plurality of connection flow paths are arranged in a matrix.

5. The developing device according to claim 1, wherein part of the development tank constitutes the flow-path forming portion.

6. The developing device according to claim 1, wherein part of the bottom wall of the exhaust duct constitutes the flow-path forming portion.

7. An image forming apparatus comprising the developing device according to claim 1.

8. The image forming apparatus according to claim 7, further comprising:

a housing that accommodates the developing device, wherein the housing has an exhaust port that communicates with an internal space of the exhaust duct, and an exhaust fan that discharges air in the internal space of the exhaust duct to an outside of the housing is disposed at the exhaust port.

* * * * *